US006343201B1

(12) United States Patent
Wada et al.

(10) Patent No.: US 6,343,201 B1
(45) Date of Patent: Jan. 29, 2002

(54) DEVELOPING APPARATUS COMPRISING DEVELOPING ROLLER THAT IS ROTATED UPWARD FROM BELOW IN DEVELOPING AREA AND IMAGE FORMING APPARATUS USING THE SAME

(75) Inventors: Minoru Wada, Kawanishi; Tetsumaru Fujita, Nishinomiya; Ichiro Demizu, Toyonaka; Eiji Gyotoku; Akihiro Kawasaki, both of Itami; Yoichi Fujieda, Nishinomiya; Hiroshi Goto, Kawanishi, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/628,034

(22) Filed: Jul. 27, 2000

(30) Foreign Application Priority Data

Jul. 29, 1999 (JP) ..... 11-214584
Aug. 5, 1999 (JP) ..... 11-222158

(51) Int. Cl.[7] ..... G03G 15/08
(52) U.S. Cl. ..... 399/281; 399/284; 399/285
(58) Field of Search ..... 399/279, 281, 399/283–285

(56) References Cited

U.S. PATENT DOCUMENTS 5,365,318 A * 11/1994 Hiraoka et al. ..... 399/281 X
5,548,386 A * 8/1996 Fukuda ..... 399/284
6,144,829 A * 11/2000 Miyasaka et al. ..... 399/281

FOREIGN PATENT DOCUMENTS

JP 8-297411 11/1996
JP 9-244406 9/1997
JP 10-171226 6/1998

* cited by examiner

*Primary Examiner*—William J. Royer
(74) *Attorney, Agent, or Firm*—McDermott, Will & Emery

(57) ABSTRACT

A developing apparatus with a developing roller for conveying toners held on its surface to a developing area opposite to an image carrying member, the surface of the developing roller being moved upward from below in the developing area; a regulating member for regulating an amount of the toners to be conveyed to the developing area by the developing roller; a plate-shaped charging member for charging the toners; and a voltage applying device for applying a voltage to the charging member.

23 Claims, 7 Drawing Sheets

Fig 1 *(PRIOR ART)*

DEVELOPING APPARATUS COMPRISING DEVELOPING ROLLER THAT IS ROTATED UPWARD FROM BELOW IN DEVELOPING AREA AND IMAGE FORMING APPARATUS USING THE SAME

BACKGROUND OF THE INVENTION

This application is based on Japanese application 214584/1999 and 222158/1999, the contents of which are hereby incorporated by reference.

1. Field of the Invention

The present invention relates generally to an image forming apparatus such as a copying machine or a printer and a developing apparatus used for the image forming aparatus, and more particularly, to a developing apparatus using only toners for a developer and adapted to rotate, in introducing the toners into a developing area opposite to an image carrying member by a developing roller to perform development, the development roller to move upward from below in the developing area opposite to the image carrying member as well as to regulate by a regulating member the amount of the toners to be conveyed to the developing area by the developing roller under the developing roller, and an image forming apparatus using the developing apparatus.

2. Description of the Related Art

Conventionally known as a developing apparatus, used in an image forming apparatus such as copying machine or a printer, has been a developing apparatus using a mono-component developer containing no carriers and only tones in addition to a developing apparatus using a two-component developer containing toners and carriers.

An example of the developing apparatus using a mono-component developer containing only toners is one as shown in FIG. 1.

In the developing apparatus, toners t contained in a containing section 1*a* in an apparatus body 1, are fed to a toner supplying member 3, in a roller shape by a toner feeding member 2, and the toner supplying member 3 is rotated, to supply the toners t to a developing roller 4.

The developing roller 4 is rotated, to convey the toners t supplied in the above-mentioned manner. Further, a regulating member 5 is pressed against the surface of the developing roller 4, to regulate by the regulating member 5 the amount of the toners t to be conveyed by the developing roller 4 as well as to subject the toners t to triboelectric charging. The toners t thus regulated and charged are introduced into a developing area opposite to an image carrying member 6 by the developing roller 4, to perform development.

In the conventional developing apparatus, the developing roller 4 and the image carrying member 6 are so rotated as to move downward from above in the developing area where the developing roller 4 and the image carrying member 6 are opposite to each other, as shown in FIG. 1.

Depending on the type of the image forming apparatus, however, it is necessary to move the image carrying member upward from below in the developing area. For example, in a color image forming apparatus using a plurality of developing apparatuses respectively containing toners having different colors and so adapted as to form toner images respectively having the colors in an image carrying member by the plurality of developing apparatuses as well as to successively transfer the toner images to an intermediate transfer member from the image carrying member, the image carrying member must, in some cases, be moved upward from below in the developing area in order to make the color image forming apparatus compact.

Consider a case where the image carrying member is thus moved upward from below in the developing area. In a case where the developing roller is so rotated as to move downward from above in the developing area, when the developing roller is brought into contact with image carrying member to perform development, the toners stay in an upstream portion where the developing roller is in contact with the image carrying member. Accordingly, the toners spill outward, and a formed image is fogged. On the other hand, when the developing roller and the image carrying member are not brought into contact with each other to perform development, a leak is liable to occur between the developing roller and the image carrying member.

In recent years, developing apparatuses each adapted so as to rotate, when an image carrying member is moved upward from below in a developing area where a developing roller and the image carrying member are opposite to each other, the developing roller so as to move upward from below in the developing area have been proposed, as disclosed in JP-A-8-297411, JP-A-9-244406, and JP-A-1-171226.

When the developing roller is rotated to move upward below in the developing area a regulating member for regulating toners supplied to the developing roller must be provided under the developing roller.

When the regulating member is thus provided under the developing roller, however, many of the toners supplied to the developing roller are dropped upon being separated from the developing roller by its own weight before being introduced into the regulating member, so that the toners in a sufficient amount are not introduced into the developing area. Accordingly, the density of a formed image is decreased.

Therefore, a developing apparatus which is provided with a sealing member so as to be brought into contact with the surface of a developing roller on the upstream side in the direction of rotation of the developing roller from a regulating member for regulating the amount of the toners in the developing roller has been proposed, as disclosed in JP-A-10-171226.

Even when the sealing member is provided to be brought into contact with the developing roller on the ups side in the direction of rotation of the developing roller from the regulating member, the toners are not sufficiently held on the developing roller, and are dropped upon being separated from the developing roller before being introduced into the position of the regulating member. Accordingly, the density of a formed image is still decreased. Particularly when a solid image containing a high proportion of a block portion is formed, the density of the obtained image is decreased, and the image becomes blurred.

SUMMARY OF THE INVENTION

An object of the present invention is to prevent, in a developing apparatus for rotating, in introducing toners into a developing area opposite to an image carrying member by a rotating developing roller to perform development, the developing roller so as to move upward from below in the developing area opposite to the image carrying member as well as regulating by a regulating member the amount of the toners to be conveyed to the developing area by the developing roller under the developing roller, the toners supplied to the developing roller from being dropped upon being separated from the developing roller before being introduced into the regulating member, to introduce the toners in a sufficient amount into the developing area.

Another object of the present invention is to obtain, when an image is formed by an image forming apparatus using the above-mentioned developing apparatus, an image having a sufficient image density, and particularly to obtain, even when a solid image containing a large proportion of an image portion is formed, a good image having a sufficient image density without being decreased in density and blurred.

A first developing apparatus according to the present invention comprises a developing roller for conveying charged toners to a developing area opposite to an image carrying member with the toners held on its surface, the developing roller being rotated upward from below in the developing area; a regulating member for regulating the amount of the toners to be conveyed to the developing area under the developing roller; a plate-shaped charging member for charging the toners; and a voltage applying device for applying a voltage to the charging member.

A second developing apparatus according to the present invention comprises a developing roller for conveying charged toners to a developing area opposite to an image carrying member with the toners held on its surface, the developing roller being rotated upward from below in the developing area; a plate-shaped regulating member for regulating the amount of the toners to be conveyed to the developing area under the developing roller; a plate-shaped charging member for charging the toners, the charging member being positioned on the upstream side in the direction of rotation of the developing roller from the regulating member, an end, on the downstream side in the direction of rotation of the developing roller, of the charging member being brought into contact with the developing roller, and a distance d from a point at which the charging member starts to come into contact with the developing roller to a front end, on the downstream side in the direction of rotation of the developing roller, of the charging member being not less than 0.3 mm.

An image forming apparatus according to the present invention comprises the first or second developing apparatus, and an image carrying member. The image carrying member is moved upward from below in the developing area.

These and other objects, advantages and features of the invention will become apparent from the following description thereof taken in conjunction with the accompanying drawings which illustrates specific embodiments of the invention.

DESCRIPTION OF THE PREFERRED EMBODIMENTS

Developing apparatuses according to embodiments of the present invention will be specifically described on the basis of accompanying drawings.

(Embodiment 1)

Figure 1:
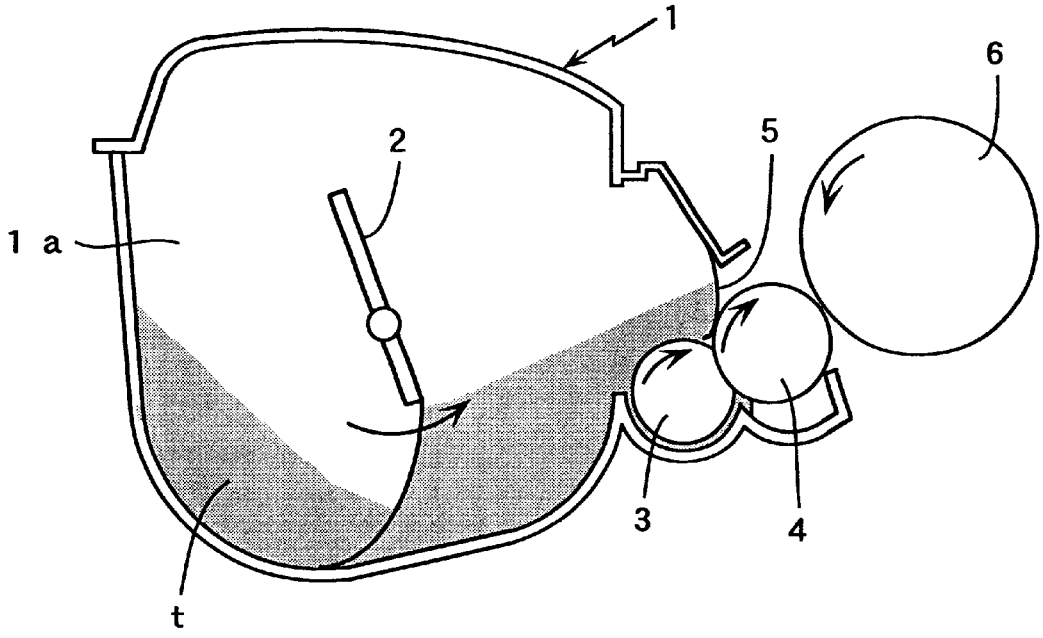
FIG. 1 is a schematic illustration of a conventional developing apparatus.
Figure 2:
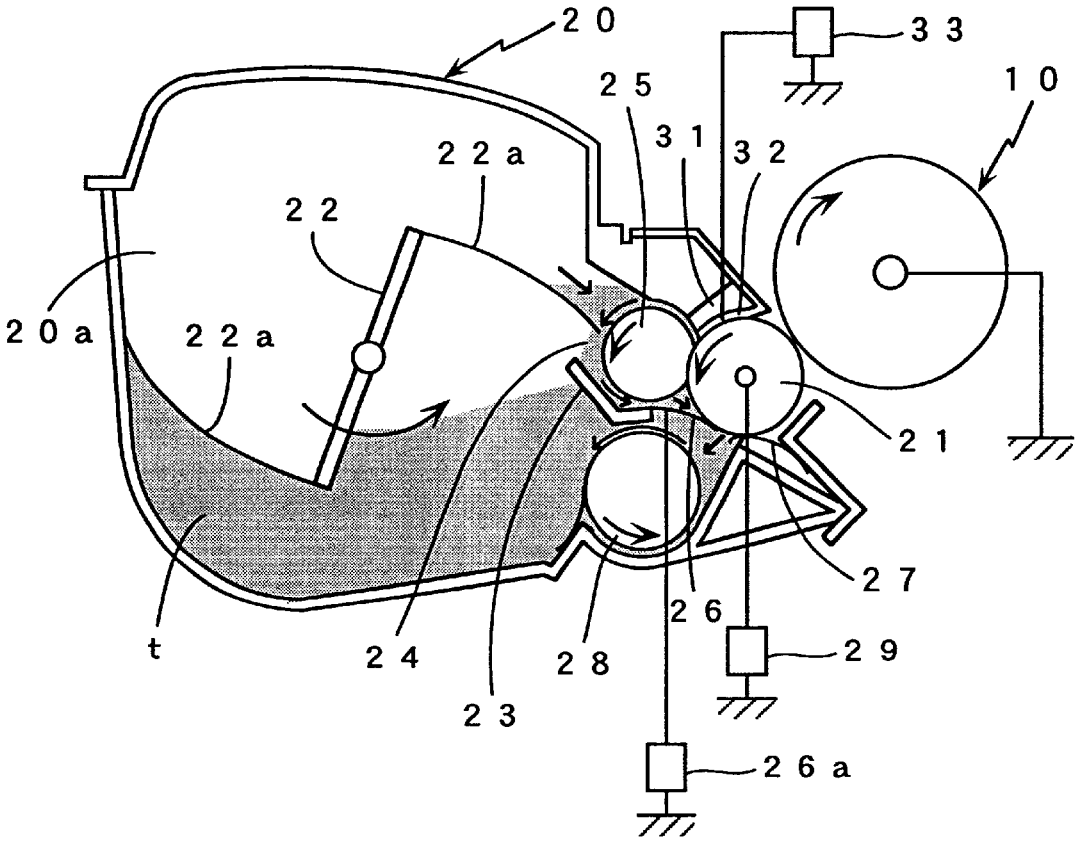
FIG. 2 is a schematic illustration of a developing apparatus according to embodiment 1 of the present invention.

In a developing apparatus according to the present invention, a developing roller 21 is provided so as to be opposed to an image carrying member 10 through a slight space, and the developing roller 21 and the image carrying member 10 are rotated in opposite directions, to respectively move upward from below in a developing area where the developing roller 21 and the image carrying member 10 are opposite to each other, as shown in FIG. 2.

In the developing apparatus, toners t are contained in a containing section 20*a* in an apparatus body 20, and a toner feeding member 22 provided with blade members 22*a* is provided so as to be rotatable.

The toner feeding member 22 is rotated, to supply the toners t contained in the conting section 20*a* to a toner shying section 24 provided with a receiving member 23 by the blade members 22*a* in the toner feeding member 22.

In the toner staying section 24, a toner supplying member 25 in a roller shape is provided so as to be brought into contact with the developing roller 21. The toner supplying member 25 is rotated in the same direction as the developing roller 21, to move in an opposite direction to the developing roller 21 in a portion where the toner supplying member 25 and the developing roller 21 are in contact with each other, and supply the toners t to the developing roller 21 from the toner supplying member 25.

One end of a charging member 26 formed in a plate shape of a conductive material is attached to the receiving member 23, and the charging member 26 is projected toward the downstream side in the direction of rotation of the developing roller 21 below the toner supplying member 25, to bring a front end of the charging member 26 into contact with the developing roller 21 at suitable line pressure along the axis of the developing roller 21 at a position on the downstream side in the direction of rotation of the developing roller 21 from the toner supplying member 25. Further, a bias voltage for charging the toners t to a predetermined polarity is applied to the charging member 26 from a bias power supply 26*a*. In the developing apparatus according to the present embodiment, a space of not less than 1 mm is provided between both ends of the charging member 26 and both sidewalls of the apparatus body 20 so that the excess toners t are returned to the containing section 20*a* in the apparatus body 20 from the space.

An end of a regulating member 27 in a plate shape, which is projected toward the upstream side in the direction of rotation of the developing roller 21 under the developing roller 21 an the downstream side in the direction of rotation of the developing roller 21 from the front end of the charging member 26 is brought into contact with the developing roller 21 so as to have a suitable space from the bent end of the charging member 26.

When the charging member 26 formed in a plate shape of a conductive material is provided so as to be brought into contact with the developing roller 21, and the bias voltage for charging the toners t to a predetermined polarity is applied to the charging member 26, as in the developing apparatus according to the present embodiment, the toners t supplied to the developing roller 21 are suitably charged to a predetermined polarity by the contact with the charging member 26.

The toners t thus charged are held on the developing roller 21 by an electrostatic force. Before the toners t are introduced into the regulating member 27 by the developing roller 21, the toners t are prevented from being dropped upon being separated from the developing roller 21, so that the toners t in a sufficient amount are introduced into the position of the regulating member 27 by the developing roller 21.

In a case where the charging member 26 is composed of a material positioned in a triboelectric series for charging the toners t to a predetermined polarity, and negatively charged toners t are used, as in the developing apparatus according to the present embodiment, when the charging member 26 is composed of a material whose work function is not more than the work function of the toners t, the toners t supplied to the developing roller 21 are further suitably charged to a predetermined polarity by the contact with the charging member 26, the toners t in a sufficient amount are introduced into the position of the regulating member 27 by the developing roller 21.

Furthermore, in bringing the front end of the charging member 26 into contact with the developing roller 21, when a surface, at the front end in contact with the developing roller 21, of the charging member 26 is too smooth, the toners t slide on the surface of the charging member 26, so that the toners t are not suitably charged and are not sufficiently held on the developing roller 21. On the other hand, when the surface, at the front end in contact with the developing roller 21, of the charging member 26 is too rough, the toners t held on the developing roller 21, and conveyed are non-uniform in amount by the contact with the charging member 26. Therefore, it is preferable that ten-point average roughness Rz on a surface, in contact with the developing roller 21, of the charging member 26 satisfies $0.1\ \mu m \leqq Rz \leqq 2.0\ \mu m$.

Furthermore, in bringing the front end of the charging member 26 into contact with the developing roller 21, as described above, when contact pressure of the charging member 26 which is brought into contact with the developing roller 21 becomes low, the toners t are not sufficiently charged by the charging member 26, so that the toners t are not sufficiently held on the developing roller 21. On the other hand, when contact pressure of the charging member 26 which is brought into contact with the developing roller 21 becomes too high, the toners having a large particle diameter do not pass through the charging member 26. Accordingly, only the toners t having small particle diameter are conveyed by the developing roller 21, and the toners t having a large particle diameter remain. Consequently, the image quality of a formed image is gradually changed. In bringing the front end of the charging member 26 into contact with the developing roller 21, it is preferable that the line pressure of the charging member 26 on the developing roller 21 is in a range of 0.1 to 4.0 gf/mm.

When the toners t are introduced into the position of the regulating member 27 by the developing roller 21, as described above, the excess toners t are separated from the developing roller 21 by the regulating member 27. Accordingly, the amount of the toners t to be conveyed to the developing area is regulated, and the toners t are charged. The toners t introduced into the position of the regulating member 27 by the developing roller 21 are suitably charged to a predetermined polarity by the charging member 26, as described above. Accordingly, the toners t are also prevented from adhering to the regulating member 27.

The excess toners t separated from the developing roller 21 by the regulating member 27, as described above, are introduced downward through the space, and are returned to the containing section 20*a* by a return roller 28 provided below the developing roller 21.

Furthermore, the toners t regulated by the regulating member 27 and charged, as described above, are conveyed to the developing area opposite to the image carrying member 10 by the developing roller 21.

In the developing area, the developing roller 21 and the image carrying member 10 are respectively moved upward from below, as described above, and a developing bias voltage which is an overlapping of an AC voltage with a DC voltage is applied to the developing roller 21 from a developing bias power supply 29, to exert a vibrating electric field between the developing roller 21 and the image carrying member 10, and the toners t are supplied to a part of an electrostatic latent image formed on the image carrying member 10 from the developing roller 21 to perform development. Although in the present embodiment, the developing roller 21 and the image carrying member 10 are opposite to each other through a slight space in the developing area to perform development, as described above, the developing roller 21 and the image carrying member 10 can be brought into contact with each other in the developing area to perform development.

After the electrostatic latent image formed on the image carrying member 10 is developed in the above-mentioned manner, the toners t remaining on the developing roller 21 are returned to the apparatus body 20. At a position where the toners t remaining on the developing roller 21 are returned to the apparatus body 20, a sealing member 32 is pressed against the developing roller 21 by a cushioning member 31, and a voltage for eliminating charges on the toners t is applied to the sealing member 32 from a charge eliminating power supply 33, to eliminate the charges on the toners t remaining on the developing roller 21.

After the charges on the toners t remaining on the developing roller 21 are thus eliminated, the toners t remaining on the developing roller 21 are separated from the developing roller 21 by the toner supplying member 25 which is moved in an opposite direction to the developing roller 21 in its portion in contact with the developing roller 21, as described above, to mix the toners t with the toners t in the toner staying section 24, and new toners t are supplied to the developing roller 21 from the toner supplying member 25.

When the toner supplying member 25 is moved in an opposite direction to the developing roller 21 in the potion in contact with the developing roller 21, as described above, the possibility that only the toners t having a large particle diameter are separated from the developing roller 21, and the toners having a small particle diameter remain, as in a case where the toner supplying member 25 is moved in the same direction as the developing roller 21, is eliminated. Accordingly, the toners t having a small particle diameter on the developing roller 21 are also reliably separated from the developing roller 21 by the toner supplying member 25. Therefore, the possibility that many of the toners t having a small particle diameter are previously used for development, and the proportion of the toners t having a large particle diameter in the containing section 20*a* is gradually increased, so that the image quality of a formed image is changed is also eliminated.

An experiment in which in bringing the front end of the charging member 26 into contact with the developing roller 21 to charge the toners t in the developing apparatus shown in FIG. 2, the bias voltage to be applied to the charging member 26 from the bias power supply 26*a* is changed is then conducted, to clarify that the developing apparatus in the embodiment of the present invention is superior by taking comparative examples.

EXPERIMENT 1—1

In this experiment, a photosensitive drum having a diameter of 30 mm was used as the image carrying member 10, while a developing roller having a diameter of 16 mm was used as the developing roller 21. The developing roller 21 and the image carrying member 10 were provided so as to be opposed to each other through a space of 200 μm. The developing roller 21 and the image carrying member 10 were rotated in opposite directions, to move upward from below in the developing area where the developing roller 21 and the image carrying member 10 are opposite to each other. The peripheral speed v1 of the image carrying member 10 was set to 160 mm/s, and the ratio θ (v2/v1) of the peripheral speed v2 of the developing roller 21 to the peripheral speed v1 of the image carrying member 10 was set to 1.5.

Used as the charging member 26 was one composed of a plate material made of SUS and having ten-point average roughness, on its surface in contact with the developing roller 21, of 0.5 μm. Used as the regulating member 27 was a plate material made of SUS having a plate thickness of 0.3 mm. Further, used as the toners t were negatively charged toners having a weight average particle diameter of 8.0 μm.

When a bias voltage Va is applied to the charging member 26 from the bias power supply 26*a* in bringing the front end of the charging member 26 into contact with the developing roller 21 to charge the toners t supplied to the developing roller 21, the same bias voltage Va (Va=Vb) as a developing bias voltage Vb to be applied to the developing roller 21 from the developing bias power supply 29 was applied in an example 1—1, and a bias voltage Va (Va=Vb−100 V) shifted by 100 V toward the side of minus that is a polarity to which the toners t are charged from the developing bias voltage Vb to be applied to the developing roller 21 from the developing bias power supply 29 was applied in an example 1-2, while no bias voltage Va was applied to the charging member 26 in a comparative example 1—1.

After the toners t supplied to the developing roller 21 were thus charged, the toners t conveyed by the developing roller 21 were then regulated by the regulating member 27, and the toners t were subjected to triboelectric charging, to introduce the toners t into a developing area opposite to the image carrying member 10.

A solid electrostatic latent image having a surface potential of −50 V was formed on the image carrying member 10, while a developing bias voltage Vb which is an overlapping of an AC voltage having a peak-to-peak value Vpp of 1600 V and having a frequency of 2 kHz with a DC voltage of −400 V was applied to the developing roller 21 from the developing bias power supply 29. The toners t were supplied to a part of the electrostatic latent image formed on the image carrying member 10 from the developing roller 21, to respectively form solid images.

Each of the solid images thus formed was evaluated. A case where the solid image having a constant image density was obtained and a case where the image density at a rear end of the solid image was greatly decreased were respectively indicated by ○ and × in Table 1:

TABLE 1

| | example 1.1 | example 1.2 | comparative example 1.1 |
|---|---|---|---|
| Va (V) | Vb | Vb-100 | not applied |
| evaluation of solid image | ○ | ○ | x |

As apparent from the results, in preliminary charging the toners t upon bringing the front end of the charging member 26 into contact with the developing roller 21, the obtained solid image was a good solid image whose density was not decreased in each of the developing apparatuses in examples 1.1 and 1.2 in which the bias voltage Va for charging the tones t on the developing roller 21 to a negative polarity from the bias power supply 26*a* was applied to the charging member 26. Contrary to this, in the developing apparatus in the comparative example 1.1 in which no bias voltage Va was applied to the charging member 26, the toners t on the developing roller 21 were not suitably charged, and were dropped upon being separated from the developing roller 21 before being introduced into the regulating member 27, so that the amount of the toners introduced the developing area was decreased. Accordingly, the image density at the rear end of the solid image was greatly decreased.

EXPERIMENT 1-2

In this experiment, the material of a surface, in contact with the developing roller 21, of the above-mentioned erging member 26 used in the experiment 1—1 was changed, to use four types of charging members 26 respectively having work functions Wf, on their surfaces in contact with the developing roller 21, of 4.2 eV, 4.6 eV, 5.0 eV, and 5.2 eV, as shown in Table 2.

In finding the work function Wf on the surface, in contact with the developing roller 21, of each of the charging members 26, a contact potentiometer (SSVII-10 manufactured by Kawaguchi Denki K.K.) was used. Au having a work function Wf of 4.9 eV was used as a basis, and a contact potential difference from Au was measured, to find the work function Wf on the surface. The work function Wf of the negatively charged toners was 5.0 eV.

In bringing each of the charging members 26 respectively having the above-mentioned work functions Wf on the surfaces into contract with the developing roller 21, and cha the toners t supplied to the developing roller 21, a bias voltage Va (=Vb−100V) shifted by 100 V toward the side of minus that is a polarity to which the toners t are charged from a developing bias voltage Vb to be applied to the developing roller 21 from the developing bias power suply 29 was applied to the charging member 26 from tlhe bias power supply 26*a,* to charge the toners t held on the developing roller 21 by the charging member 26, and the toners t thus charged were introduced into the regulating member 27 by the developing roller 21, to regulate by the regulating member 27 the amount of the toners t to be conveyed by the developing roller 21.

The adhering state of the toners t on the regulating member 27 which had thus regulated the amount of the toners t to be conveyed by the developing roller 21 was examined. A case where the toners did not adhere to the regulating member and a case where the toners adhered to the regulating member were respectively indicated by ○ and × in Table 2:

TABLE 2

| | | | | |
|---|---|---|---|---|
| Wf (eV) on surface of charging member | 4.2 | 4.6 | 5.0 | 5.2 |
| adhesion of toners to regulating member | ○ | ○ | ○ | x |

As apparent from the results, when the negatively charged toners were used, a portion where the charging member 26 is in contact with the developing roller 21 was composed of a material whose work function is not more than the work function of the toners t, the toners t were negatively charged by the contact with the charging member 26, so that the toners t did not adhere to the regulating member 27.

Contrary to this, when the portion where the charging member 26 is in contact with the developing roller 21 was composed of a material whose work function is higher than the work function of the toners t, toners t positively charged were produced by the contact with the charging member 26. The toners t thus positively charged adhered to the regulating member 27, so that the toners t to be conveyed by the developing roller 21 are non-uniform in a stripe shape, and stripe-shaped noise occurred in a formed image.

EXPERIMENT 1-3

In this experiment, used as the charging member 26 was ones composed of a plate material made of SUS, as in the above-mentioned experiment 1, while having ten-point average roughness Rz, on their surfaces in contact with the developing roller 21, changed in a range of 0.05 to 2.5 μm, as shown in the following Table 3.

In bringing each of the charging members 26 into contact with the developing roller 21, to charge toners t supplied to the developing roller 21, a bias voltage Va(=Vb−100V) shifted by 100 V toward the side of minus than is a polarity to which the toners t are charged from a developing bias voltage Vb to be applied to the developing roller 21 from the developing bias power supply 29 was applied to the charging member 26 from the bias power supply 26*a,* to charge the toners t held on the developing roller 21 by the charging member 26, as in the abovementioned examples 1-2.

The toners t charged by each of the charging members 26 as described above were then introduced into the regulating member 27 by the developing roller 21, to regulate by the regulating member 27 the amount of the toners t held on the developing roller 21 as well as to subject the toners t to triboelectric charging, to introduce the toners t to a developing am opposite to the image carrying member 10.

Non-uniformity in conveyance of the toners t on the developing roller 21 thus introduced into the developing area opposite to the image carrying member 10 was visually observed. A case where there was no non-uniformity in conveyance and a case where there was non-uniformity in conveyance were respectively indicated by ○ and × in Table 3.

A solid electrostatic latent image having a surface potential of −50 V was formed on the image carrying member 10, while a developing bias voltage Vb which is an overlapping of an AC voltage having a peak-to-peak value Vpp of 1600 V and having a frequency of 2 kHz with a DC voltage of −400 V was applied to the developing roller 21 from the developing bias power supply 29. The toners t were supplied to a part of the electrostatic latent image formed on the image carrying member 10 from the developing roller 21, to respectively form solid images, as in the above-mentioned experiment 1—1.

Each of the solid images thus formed was evaluated. A case where the solid image having a constant image density was obtained and a case where the image density at a rear end of the solid image was greatly decreased were respectively indicated by ○ and × in Table 3:

TABLE 3

| | | | | |
|---|---|---|---|---|
| Rz (μm) | 0.05 | 0.1 | 2.0 | 2.5 |
| non-uniformity in conveyance | ○ | ○ | ○ | x |
| evaluation of solid image | x | ○ | ○ | ○ |

As apparent from the results, when the charging member 26 having ten-point average roughness Rz, at its front end in contact with the developing roller 21, in a range of 0.1 to 2.0 μm was used, the toners t to be conveyed to the developing area by the developing roller 21 were not non-uniform in amount. Accordingly, the obtained solid image was a good solid image which was not non-uniform in density and whose density was not decreased.

Contrary to this, when the charging member 26 having ten-point average roughness Rz, at its front end in contact with the developing roller 21, of less than 0.1 μm was used, the loners t on the developing roller 21 were not suitably charged, so that the toners t were not sufficiently held on the developing roller 21. The toners t were dropped upon being separated form the developing roller 21 before being introduced into the regulating member 27, and the amount of the toners t introduced into the developing area was decreased, so that to density of the solid image was decreased. On the other hand, when the charging member 26 having ten-point average roughness Rz, at its front end in contact with the developing roller 21, exceeding 2.0 μm was used, the toes t held in the developing roller 21 and conveyed were non-uniform in amount by the contact with the charging member 26.

(Embodiment 2)

Figure 3:
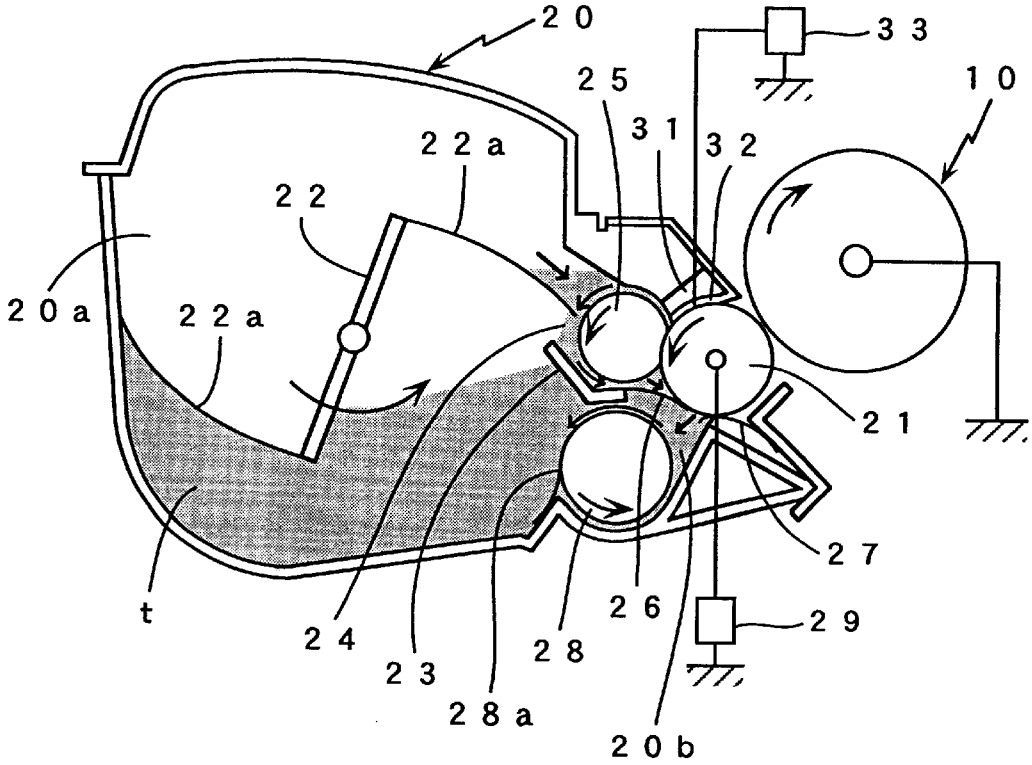
FIG. 3 is schematic illustration of a developing apparatus according to embodiment 2 of the present invention.

Also in a developing apparatus according to the present invention, a developing roller 21 is provided so as to be opposed to an image carrying member 10 through a slight space, and the developing roller 21 and the image carrying member 10 are rotated in opposite directions, to respectively move upward from below in a developing area where the developing roller 21 and the image carrying member 10 are opposite to each other, as in the developing apparatus according to embodiment 1, as shown in FIG. 3.

Toners t are contained in a containing section 20*a* in an apparatus body 20, and a toner feeding member 22 provided with blade members 22*a* is provided so as to be rotatable.

The toner feeding member 22 is rotated, to supply the toners t contained in the containing section 20*a* to a toner staying section 24 provided with a receiving member 23 by the blade members 22*a* in the toner feeding member 22.

In the toner staying section 24, a toner supplying member 25 in a roller shape is provided so as to be brought into contact with the developing roller 21. The toner supplying member 25 is rotated in the same direction as the developing roller 21, to move in an opposite direction to the developing roller 21 in a portion where the toner supplying member 25 and tie developing roller 21 are in contact with each other, and the toners t are supplied to the developing roller 21 from the toner supplying member 25.

One end of a charging member 26 formed in a plate shape is attached to the receiving member 23, and the charging member 26 is projected toward the downstream side in the direction of rotation of the developing roller 21 below the toner supplying member 25, to bring a front end of the charging member 26 into contact with the developing roller 21 at suitable line pressure at a position on the downstream side in the direction of rotation of the developing roller 21 from the toner supplying member 25.

Figure 4:
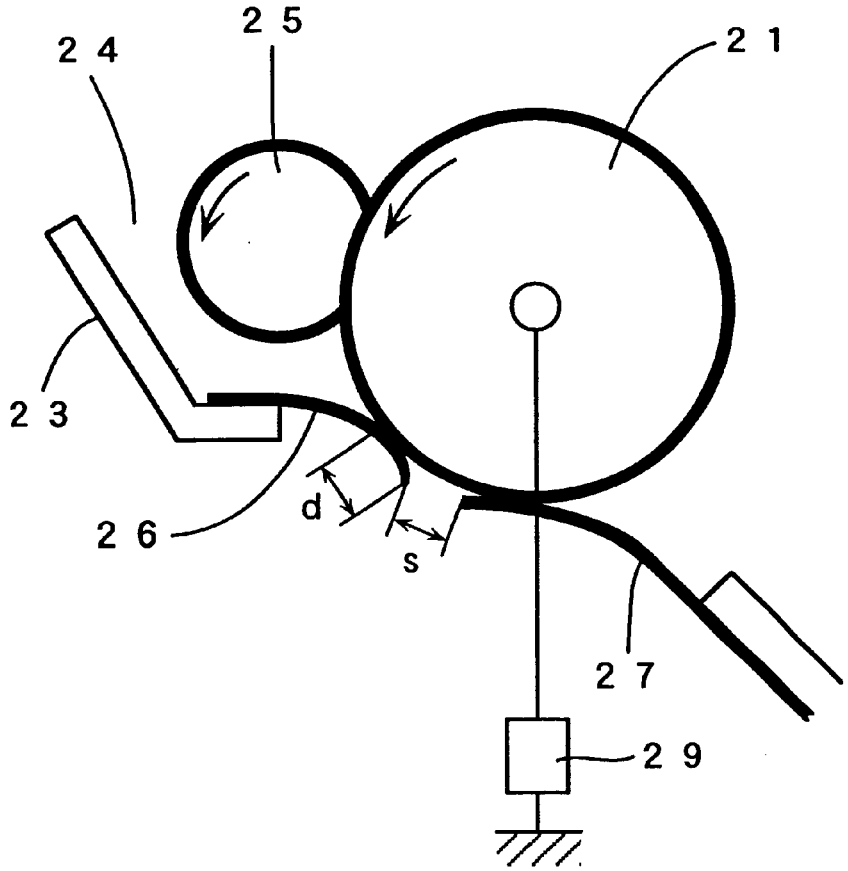
FIG. 4 is a partial illustration of a state where a charging member and a regulating member are brought into contact with a developing roller in the developing apparatus according to tho embodiment 2.

In the developing apparatus according to the present embodiment, in bringing the front end of the charging member 26 into contact with the developing roller 21, as shown in FIG. 4, a distance d from a point at which the charging member 26 starts to come into contact with the developing roller 21 to the front end of the charging member 26 is set to not less than 0.3 mm, to charge the toners t supplied to the developing roller 21 by the charging member 26.

Under the developing roller 21 on the downstream side in the direction of rotation of the developing roller 21 from the front end of the charging member 26, an end of a regulating member 27 in a plate shape which is projected toward the upstream side in the direction of rotation of the developing roller 21 is brought into contact with the developing roller 21 so as to have a suitable space s from the front end of the charging member 26.

When the charging member 26 is brought into contact with the developing roller 21 in such a manner that the distance d from to point at which the charging member 26 starts to come into contact with the developing roller 21 to the front end of the developing roller 21 is not less than 0.3 mm, as described above, the toners t supplied to the developing roller 21 are suitably charged by the contact with the charging member 26. Accordingly, the toners t thus charged are held on the developing roller by an electrostatic force. The toners t are prevented from being dropped upon being separated from the developing roller 21 before being introduced into the regulating member 27 by the developing roller 21. Accordingly, the toners t in a sufficient amount are introduced into the position of the regulating member 27 by the developing roller 21.

In the developing apparatus according to the present embodiment, in bringing the front end of the regulating member 27 into contact with the developing roller 21 so as to have a suitable space s from the front end of the charging member 26, as described above, when the space s between the charging member 26 and the regulating member 27 is narrowed, the space between the charging member 26 and the regulating member 27 is clogged with the toners t conveyed by the developing roller 21. Accordingly, the toners t cannot be suitably regulated by the regulating member 27, and the toners t may be non-uniform in amount. Therefore, it is preferable that the space s between the front end, on the downstream side in the direction of rotation of the developing roller 21, of the charging member 26 and the end, on the side of the charging member 26, of the regulating member 27 is not less than 0.2 mm.

Also in the developing apparatus according to he present embodiment, in bringing the front end of the charging member 26 into contact with the developing roller 21, as in the developing apparatus according to embodiment 1, when the surface, at the front end in contact with the developing roller 21, of the charging member 26 is too smooth, the toners t slide on the surface of the charging member 26, so that the toners t are not suitably charged and are not sufficiently held on the developing roller 21. On the other hand, when the surface, at the front end in contact with the developing roller 21, of the charging member 26 is too rough, the toners t held on the developing roller 21 and conveyed are non-uniform in amount by the contact with to charging member 26. Therefore, it is preferable that ten-point average roughness Rz on the surface, in contact with the developing roller 21, of the charging member 26 satisfies 0.1 $\mu$m Rz 2.0 $\mu$m.

Furthermore, in bringing the front end of the charging member 26 into contact with the developing roller 21, as described above, when contact pressure of the charging member 26 which is brought into contact with the developing roller 21 becomes low, the toners t are not sufficiently charged by the charging member 26.

Accordingly, the toners t are not sufficiently held on the developing roller 21. On the other hand, when contact pressure of the charging member 26 which is brought into contact with the developing roller 21 becomes too high, the toners having a large particle diameter do not pass through the charging member 26. Accordingly, only the toners t having a small particle diameter are conveyed by the developing roller 21, and the toners t having a large particle diameter remain. Consequently, the image quality of a formed image is gradually changed. In bringing the front end of the charging member 26 into contact with to developing roller 21, therefore, it is preferable that line pressure of the charging member 26 on the developing roller 21 is in a range of 0.1 to 4.0 gf/mm.

When the toners t are introduced into the position of the regulating member 27 by the developing roller 21, as described above, the excess toners t are separated from the developing roller 21 by the regulating member 27. Accordingly, the amount of the toners t to be conveyed to the developing area is regulated, and the toners t are charged. The toners t introduced into the position of the regulating member 27 by the developing roller 21 are suitably charged to a predetermined polarity by the charging member 26, as described above. Accordingly, the toners t are also prevented from adhering to the regulating member 27.

In the developing apparatus according to the present embodiment, a toner discharge section **20*b* is provided below the receiving member 23, and a return roller 28 is provided in the toner discharge section 20*b*. A scraping member 28*a* is brought into contact with the return roller 28 on the side of the containing section 20*a***.

The excess toner t separated from the developing roller 21 by the regulating member 27, as described above, are introduced into the toner discharge section **20*b*, and the return roller 28 is rotated, to introduce the toners t which have been introduced into the toner discharge section 20*b* into the containing section 20*a* through a space between the return roller 28 and the receiving member 23. The toners t are separated from the return roller 28 by the scraping member 28*a*, and are returned to the containing section 20*a*. In introducing the toners t into the containing section 20*a* through the space between the return roller 28 and the receiving member 23 by the return roller 28, as described above, when the space between the return roller 28 and the receiving member 23 is narrowed, the space between the return roller 28 and the receiving member 23 is clogged with the toners t Accordingly, the toners t are not easily introduced into the containing section 20*a*. On the other hand, when the space between he return roller 28 and the receiving member 23 is widened because the diameter of the return roller 28 is decreased, the amount of the toners t remaining in the toner discharge section 20*b* is increased. Accordingly, it is preferable that the minimum space between the return roller 28 and the receiving member 23** is in a range of 1 mm to 3 mm.

Figure 5:
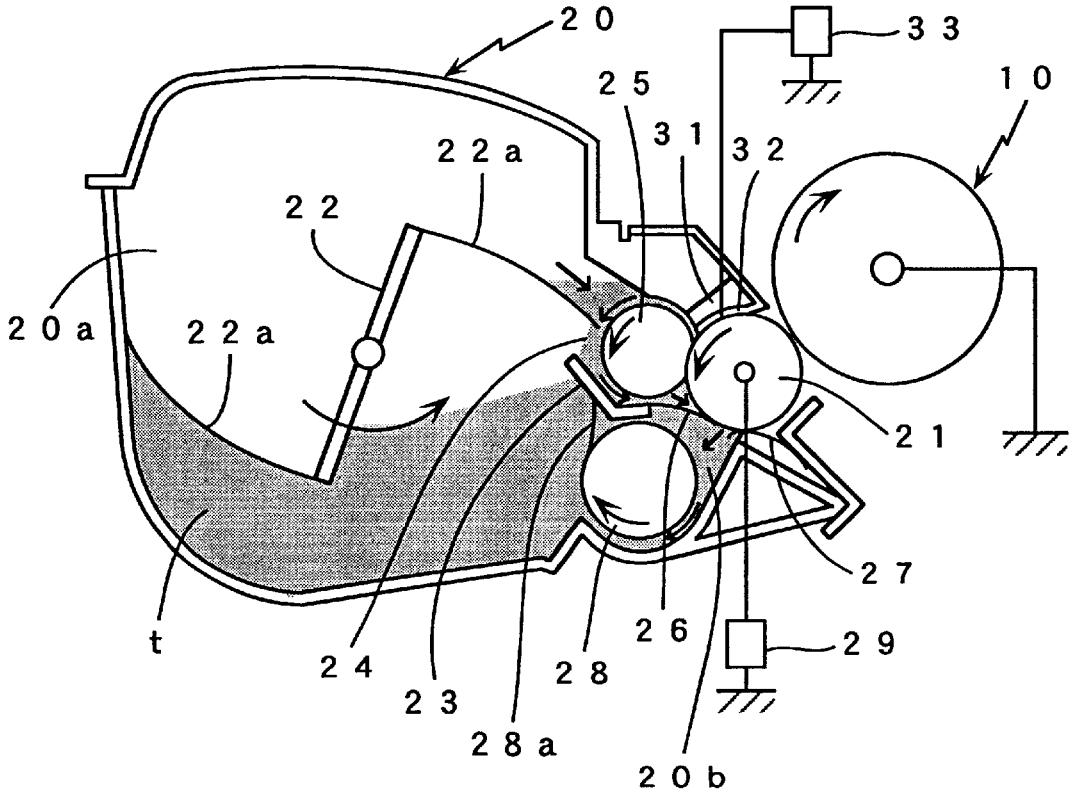
FIG. 5 is a schematic illustration showing a modified example of developing apparatus according to th embodiment 2.

Although in the developing apparatus according to the present embodiment, the toners t which have been introduced into the toner discharge section **20*b* are introduced into the containing section 20***a* through the space between the return roller 28 and the receiving member 23 by the return roller 28, as described above, it is also possible to rotate the return roller 28 in an opposite direction to that in the above-mentioned case, introduce the toners t which have been introduced into the toner discharge section 20*b* into the containing section 20*a* through a space between the return roller 28 and the bottom of the apparatus body 10 by the return roller 28, and separate the toners t from the return roller 28 by the scraping member 28*a* to return the tones t to the containing section 20*a,* as shown in FIG. 5. In this case, it is preferable that mimimum space between the return roller 28 and the bottom of the apparatus body 20 is in a range of 1 mm to 3 mm.

The toners t regulated by the regulating member 27 and charged, as described above, are conveyed to the developing area opposite to the image carrying member 10 by the developing roller 21.

In the developing area, the developing roller 21 and the image carrying member 10 are respectively moved upward from below, as described above, and a developing bias voltage which is an overlapping of an AC voltage with a DC voltage is applied to the developing roller 21 from a developing bias power supply 29, to exert a vibrating electric field between the developing roller 21 and the image carrying member 10, and the toners t are supplied to a part of the electrostatic latent image formed on the image carrying member 10 from the developing roller 21 to perform development. Although in the present embodiment, the developing roller 21 and the image carrying member 10 are opposite to each other through a slight space in the developing area to perform development, as described above, the developing roller 21 and the image carrying member 10 can be also brought into contact with each other in the developing area to perform development.

After an electrostatic latent image formed on the image carrying member 10 is developed in the above-mentioned manner, the toners t remaining on the developing roller 21 are returned to the apparatus body 20. At the position where the toners t remaining on the developing roller 21 are returned to the apparatus body 20, a sealing member 32 is pressed against the developing roller 21 by a cushioning member 31, and a voltage for eliminating charges on the toners t is applied to the sealing member 32 from a charge eliminating power supply 33, to eliminate the charges on the toners t remaining on the developing roller 21.

After the charges on the toners t remaining on the developing roller 21 are thus eliminated, the toners t remaining on the developing roller 21 are separated from the developing roller 21 by the toner supplying member 25 which is moved in an opposite direction to the developing roller 21 in its portion in contact with the developing roller 21, as described above, to mix the toners t with the toners t in the toner staying section 24, and new toners t are supplied to the developing roller 21 from the toner supplying member 25, as described above.

When the toner supplying member 25 is moved in an opposite direction to the developing roller 21 in the portion in contact with the developing roller 21, as described above, the possibility that only the toners t having a large particle diameter are separated from the developing roller 21, and the toners t having a small particle diameter remain, as in a case where the toner supplying member 25 is moved in the same direction as the developing roller 21, is eliminated. Accordingly, the toners t having a small particle diameter on the developing roller 21 are also reliably separated from the developing roller 21 by the toner supplying member 25. Therefore, the possibility that many of the toners t having a small particle diameter are previously used for development, and the proportion of the toners t having a large particle diameter in the containing section 20*a* is gradually increased, so that the image quality of a formed image is changed is also eliminated.

An experiment in which in bringing the front end of the charging member 26 into contact with the developing roller 21 to charge the toners t in the developing apparatus shown in FIG. 3, the distance d from the point at which the charging member 26 starts to come into contact with the developing roller 21 to the front end of the charging member 26 is changed is then conducted, to clarify that the developing apparatus in the present embodiment satisfying the conditions of the present invention is superior by taking comparative examples.

EXPERIMENT 1—1

In this experiment, a photosensitive drum having a diameter of 30 mm was used as the image carrying member 10, while a developing roller having a diameter of 16 mm was used as the developing roller 21. The developing roller 21 and the image carrying member 10 were provided so as to be opposed to each other through a space of 200 $\mu$m. The developing roller 21 and the image carrying member 10 were rotated in opposite directions, to move upward from below in the developing area where the developing roller 21 and the image carrying member 10 are opposite to each other. The peripheral speed v1 of the image carrying member 10 was set to 160 mm/s, and the ratio θ (v2/v1) of the peripheral speed v2 of the developing roller 21 to the peripheral speed v1 of the image carrying member was set to 1.5.

Used as the charging member 26 was one composed of a plate material made of SUS having a plate thickness of 0.3 mm and having ten-point average roughness, on its surface in contact with the developing roller 21, of 0.5 $\mu$m. Used as the regulating member 27 was a plate material made of SUS having a plate thickness of 0.08 mm. A space s between a front end, on the downstream side in the direction of rotation of the developing roller 21, of the charging member 26 and an end, on the side of the charging member 26, of the regulating member 27 was set to 2.8 mm. Further, used as the toners t were negatively charged toners having a weight average particle diameter of 8.0 $\mu$m.

In bringing the front end of the charging member 26 into contact with developing roller 21, line pressure of the charging member 26 on the developing roller 21 was set to 1.0 gf/mm, and a distance d from a point at which the charging member 26 starts to come into contact with the developing roller 21 to the front end of the developing roller 21 was changed in a range 0.1 mm to 2.0 mm, as shown in Table 4.

The toner t held on the developing roller 21 were charged by each of the charging members 26, the amount of the toners t to be conveyed by the developing roller 21 was regulated by the regulating member 27, and the amount of the toners (mg/cm$^2$) introduced into the developing area opposite to the the carrying member 10 by the developing roller 21 was measured. The results were shown in Table 4. In introducing the toners t into the developing area opposite to the image carrying member 10 by the developing roller 21 to perform development, the amount of the toners introduced into the developing area must be not less than 0.6 mg/cm$^2$ in order to obtain an image having a sufficient image density.

TABLE 4

| | | | | | |
|---|---|---|---|---|---|
| d (mm) | 0.1 | 0.2 | 0.3 | 0.4 | 0.5 ~ 2.0 |
| amount of toners ($mg/cm^2$) introduced into developing area | 0.1 | 0.4 | 0.6 | 0.7 | 0.7 |

As apparent from the results, in bringing the front end of the charging member 26 into contact with the developing roller 21, when the distance d from the point at which the charging member 26 starts to come into contact with the developing roller 21 to the front end of the charging member 26 was set to not less than 0.3 mm satisfying the conditions of the present invention, the amount of the toners introduced into the developing area was not less than 0.6 $mg/cm^2$. Accordingly, an image having a sufficient image density was obtained. Contrary to this, when the distance d from the point at which the charging member 26 starts to come into contact with the developing roller 21 to the front end of the charging member 26 was less than 0.3 mm, the amount of the toners introduced into the developing area was less than 0.6 $mg/cm^2$. Accordingly, an image having a sufficient image density was not obtained. When the distance d from the point at which the charging member 26 starts to come into contact with the developing roller 21 to the front end of the charging member 26 was not less than 0.4 mm, the amount of the toners t conveyed by the developing roller 21 was regulated by the regulating member 27, as described above, so that the amount of the toners introduced into the developing area was 0.7 $mg/cm^2$ in either case.

EXPERIMENT 2—2

In this experiment the lengths of the charging member 26 and the regulating member 27 which were used in the experiment 2-1 were changed, to change the distance d from the point at which the charging member 26 starts to come into contact with the developing roller 21 to the front and of the charging member 26 and the space s between the front end, on the downstream side in the direction or rotation of the developing roller 21, of to charging member 26 and the end, on the side of the charging member 26, of the regulating member 27 were respectively changed, as shown in Table 5.

After toners t held on the developing roller 21 as described above were charged by to charging member 26, the amount of the toners t to be conveyed by the developing roller 21 was regulated by the regulating member 27, and the toners t were subjected to triboelectric charging, to introduce the toners t into a developing area opposite to the image carrying member 10 by the developing roller 21.

A solid electrostatic latent image having a surface potential of −50 V was then formed on the image carrying member 10, while a developing bias voltage which is an overlapping of an AC voltage having a peak-to-peak value Vpp of 1600 V and having a frequency of 2 kHz with a DC voltage of −400 V was applied to the developing roller 21 from the developing bias power supply 29. The toners t were supplied to a part of the electrostatic latent image formed on the image carrying member 10 from the developing roller 21 to perform development, to respectively form solid images.

With respect to each of the solid images formed by changing the distance d from the point at which the charging member 26 starts to come into contact with the developing roller 21 and the front end of the charging member 26 and the space s between the front end, on the downstream side in the direction of rotation of the developing roller 21, of the charging member 26 and the end, on the side of the charging member 26, of the regulating member 27, the image density and image noise were evaluated. The results thereof were shown in Table 5.

In evaluating the image density, a case where the image density in the solid image was not decreased to the end and a case where the image density was decreased were respectively indicated by ○ and ×. Further, in evaluating the image noise, the presence or absence of white stripe noise in the solid image was examined. A case where no white stripe noise existed and a case where white stripe noise existed were respectively indicated by ○ and ×.

TABLE 5

| | | | | | | | |
|---|---|---|---|---|---|---|---|
| d (mm) | 3.2 | 3.1 | 3.0 | 2.9 | 2.8~0.3 | 0.2 | 0.1 |
| S (mm) | 0.1 | 0.2 | 0.3 | 0.4 | 0.5~3.0 | 3.1 | 3.2 |
| image density | ○ | ○ | ○ | ○ | ○ | X | X |
| image noise | X | ○ | ○ | ○ | ○ | ○ | ○ |

As apparent from the results, in bringing the front end of the charging member 26 into contact with the developing roller 21, when the distance d from the point at which the charging member 26 starts to come into contact with the developing roller 21 to the front end of the charging member 26 was not less than 0.3 mm and the space s between the front end, on the downstream side in the direction of rotation of the developing roller 21, of the charging member 26 and the end, on the side of the charging member 26, of the regulating member 27 was not less than 0.2 mm, the solid image whose density was not decreased was obtained, and no white stripe noise occurred in the solid image.

Contrary to this, when the distance d from the point at which the charging member 26 starts to come into contact with the developing roller 21 to the front end of the charging member 26 was less than 0.3 mm, the amount of the toners introduced into the developing area was decreased, as described above, so that the density of the solid image was decreased. Further, the space s between the front end, on the downstream side in the direction of rotation of the developing roller 21, of the charging member 26 and the end, on the side of the charging member 26, of the regulating member 27 was less than 0.2 mm, the space between the charging member 26 and the regulating member 27 was partially clogged with the toners t conveyed by the developing roller 21, and the toners t were not conveyed by the developing roller 21 in the space. Consequently, white stripe noise occurred in the solid image.

EXPERIMENT 2-3

In this experiment, solid images were formed in the same manner as that in the above-mentioned experiment 2-2 except that ten-point average roughness Rz at the front end, in contact with the developing roller 21, of the charging member 26 was changed in a range of 0.05 to 2.2 $\mu$m, as shown in Table 6, in the above-mentioned experiments 2-1 and 2-2, while the distance d from the point at which the charging member 26 starts to come into contact with the developing roller 21 to the front end of the charging member 26 was set to 0.5 mm, and the space s between the front end, on the downstream side in the direction of rotation of the developing roller 21, of the charging member 26 and the end, on the side of the the charging member 26, of the regulating member 27 was set to 2.8 mm.

With respect to each of the formed solid images, the image density and the non-uniformity in density were evaluated. The results thereof were shown in the following Table 6.

In evaluating the image density, a case where the image density in the solid image was not decreased to the end and a case where the image density was decreased were respectively indicted by ○ and ×, as in the above-mentioned experiment 2-2. Further, in evaluating the non-uniformity in density, the presence or absence of non-uniformity in tone in the solid image was examined. A case where no non-uniformity in tone occurred and a case where non-uniformity in tone occurred were respectively indicated by ○ and ×.

TABLE 6

| RZ (μm) | 0.05 | 0.1 | 0.2 | 0.3 | 0.4 | 0.5~2.0 | 2.1 | 2.2 |
|---|---|---|---|---|---|---|---|---|
| image density | X | ○ | ○ | ○ | ○ | ○ | ○ | ○ |
| non-uniformity of image | ○ | ○ | ○ | ○ | ○ | ○ | X | X |

As apparent from the results, when the charging member 26 having the ten-point average roughness Rz, at the front end in contact with the developing roller 21, in a range of 0.1 to 2.0 μm was used, the solid image whose density was not decreased was obtained, and no non-uniformity occurred in the solid image.

Contrary to this, when the charging member 26 having the ten-point average roughness Rz, at the front end in contact with the developing roller 21, of less than 0.1 μm was used, the toners t in the developing roller 21 were not suitably changed, so that the toners t were not sufficiently held on the developing roller 21. The toners t were dropped upon being separated from the developing roller 21 before being introduced into the regulating member 27, and the amount of the toners t introduced into the developing area was decreased, so that e density of the solid image was decreased. On the other hand, when the charging member 26 having the ten-point average roughness Rz, at the front end in contact with the developing roller 21, exceeding 2.0 μm was used, the toners t held on the developing roller 21 and conveyed were non-uniform in amount by the contact with the charging member 26, so that non-uniformity in tone occurred in the solid image.

Two types of image forming apparatuses for forming a color image using the developing apparatuses described in the embodiments 1 and 2 will be specifically described on the basis of accompanying drawings.

(First Color Image Forming Apparatus)

Figure 6:
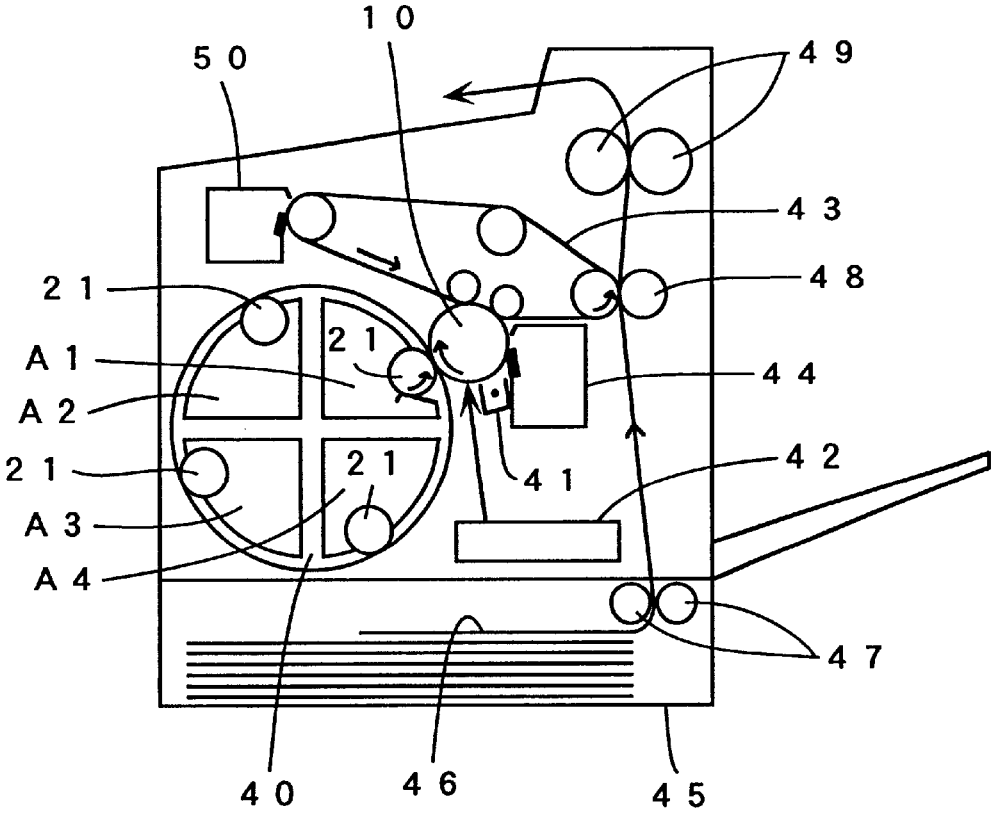
FIG. 6 is a schematic illustration of a first color image forming apparatus using developing apparatus according to the present invention.

In a first color image forming apparatus, four developing apparatuses A1 to A4 are used, toners respectively having different colors, i.e., yellow, magenta, cyan, and black colors are contained in the four developing apparatuses A1 to A4, and the four developing apparatuses A1 to A4 are held in a rotating holder 40, as shown in FIG. 6.

The holder 40 is rotated to change the positions of the developing apparatuses A1 to A4, to successively introduce a developing roller 21 in each of the developing apparatuses A1 to A4 into a position opposite to an image carrying member 10, and respectively move the developing roller 21 and the image carrying member 10 upward from below in a developing area where the developing roller 21 and the image carrying member 10 are opposite to each other.

In forming a color image by the first color image forming apparatus, the developing roller 21 in the first developing apparatus A1 containing the yellow toners are first positioned so as to be opposed to the image carrying member 10, and the image carrying member 10 is rotated, to uniformly charge the surface of the image carrying member 10 by a charging device 41. The image carrying member 10 thus charged is subjected to exposure conforming to an image signal by an exposing device 42, to form an electrostatic latent image on the surface of the image carrying member 10.

In a developing area where the image carrying member 10 having the electrostatic latent image thus formed thereon and the developing roller 21 in the first developing apparatus A1 are opposite to each other, the developing roller 21 and the image carrying member 10 are then respectively moved upward from below, the yellow toners are supplied to a part of the electrostatic latent image formed on the image carrying member 10 from the developing roller 21 to form a yellow toner image corresponding to the electrostatic latent image on the image carrying member 10.

The yellow toner image thus formed on the image carrying member 10 is transferred to an intermediate transfer member 43 in an endless belt shape which is stretched above the image carrying member 10, while the yellow toners remaining in the image carrying member 10 after the transfer are removed from the image carrying member 10 by a cleaning device 44.

Thereafter, the holder 40 is rotated, to then position the developing roller 21 in the second developing apparatus A2 containing the magenta toners so as to be opposed to the image carrying member 10. As in the first developing apparatus A1, a magenta toner image is formed on the surface of the image carrying member 10, and the magenta toner image is transferred to the intermediate transfer member 43 to which the yellow toner image has been transferred, while the magenta toners remaining in the image carrying member 10 after the transfer are removed from the image carrying member 10 by the cleaning device 44.

By performing similar operations, a cyan toner image is formed on the surface of the image carrying member 10 by the third developing apparatus A3 containing the cyan toners, and the cyan toner image is transferred to the intermediate transfer member 43. Further, a black toner image is formed on the surface of the image carrying member 10 by the fourth developing apparatus A4 containing the black toners, and the black toner image is transferred to the intermediate transfer member 43. The yellow, magenta, cyan, and black toner images are thus transferred to the intermediate transfer member 43, to form a full-color toner image.

Recording sheets 46 are introduced from a paper cassette 45 provided in a lower part of the color image forming apparatus into a portion where the intermediate transfer member 43 and a transfer roller 48 are opposite to each other by feeding rollers 47, and the full-color toner image formed on the intermediate transfer member 43 is transferred to the recording sheets 46. The full-color toner image thus transferred to the recording sheet 46 is fixed to the recording sheets 46 by a fixing device 49 to discharge the recording sheets 46, while the toners remaining on the intermediate transfer member 43 without being transferrd are removed from the intermediate transfer member 43 by a cleaning device 50.

(Second Color Image Forming Apparatus)

Figure 7:
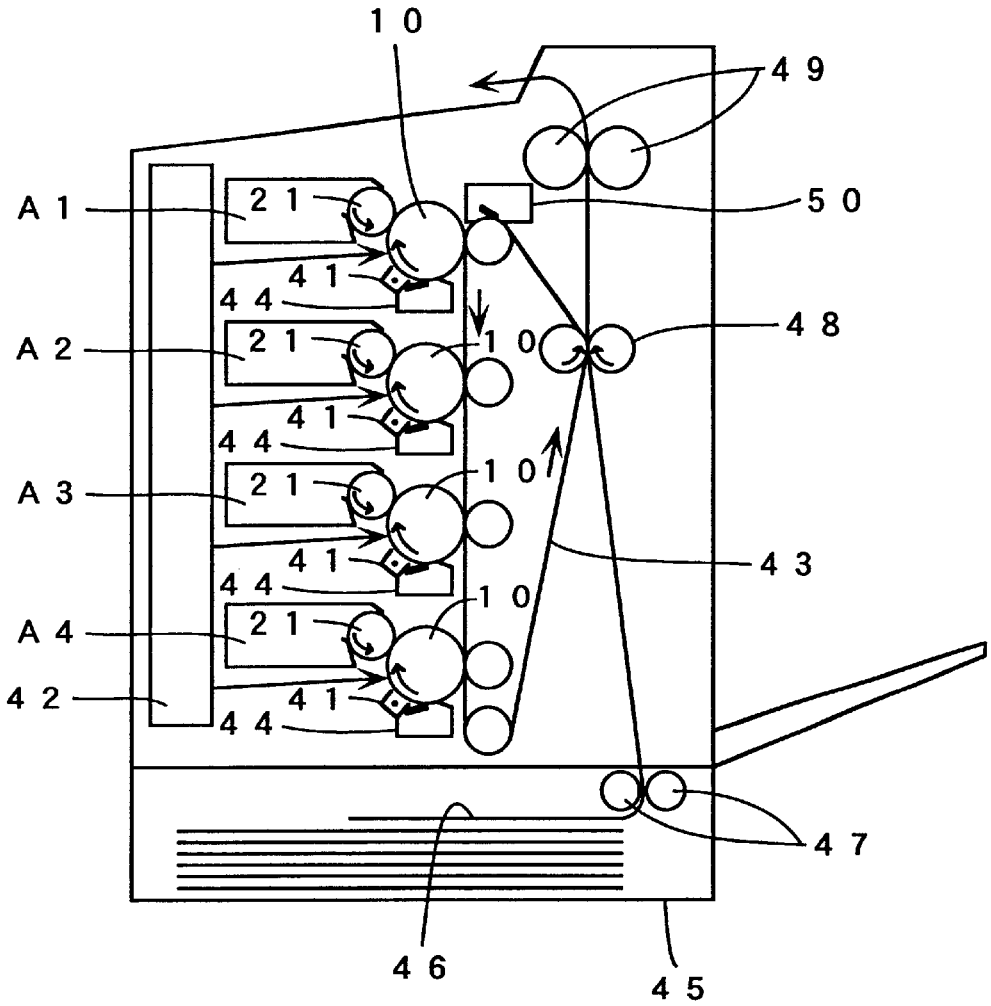
FIG. 7 is a schematic illustration of a second color image forming apparatus using developing apparatus according to the present invention.

In a second color image forming apparatus, four developing apparatuses A1 to A4 are used, toners respectively having different colors, i.e., yellow, magenta, cyan, and black colors are contained in the four developing apparatuses A1 to A4, and the four developing apparatuses A1 to A4 are arranged in descending order in the color image forming apparatus, as shown in FIG. 7.

An image carrying member 10 is provided so as to be opposed to a developing roller 21 in each of the developing apparatuses A1 to A4, to move the developing roller 21 and the image carrying member 10 upward from below in a developing area where the developing roller 21 and the image carrying member 10 are opposite to each other.

An intermediate transfer member 43 in an endless belt shape which is stretched in the vertical direction is provided at a position on the opposite side, through the image carrying member 10, to each of the developing apparatuses A1 to A4, to move the intermediate transfer member 43 downward from above on the side of the contact with the image carrying member 10.

In forming a color image by the second color image forming apparatus, consider a case of the first developing apparatus A1 containing the yellow toners. The developing roller 21 and the image carrying member 10 opposite to the developing roller 21 are rotated, to uniformly charge the surface of the image carrying member 10 by a charging device 41. The image carrying member 10 thus charged is subjected to exposure conforming to an image signal by an exposing device 42, to form an electrostatic latent image on the surface of the image carrying member 10.

In a developing area where the image carrying member 10 having the electrostatic latent image formed thereon and the developing roller 21 in the first developing apparatus A1 are opposite to each other, the developing roller 21 and the image carrying member 10 are respectively moved upward from below, to supply the yellow toners to a part of the electrostatic latent image formed on the image carrying member 10 from the developing roller 21, thereby forming a yellow toner image corresponding to the electrostatic latent image on the image carrying member 10.

The yellow toner image thus formed on the image carrying member 10 is then transferred to the intermediate transfer member 43, while the yellow toners remaining on the image carrying member 10 after the transfer are removed from the image carrying member 10 by a cleaning device 44.

As in the above-mentioned first developing apparatus A1, magenta, cyan, and black toner images are successively formed on image carrying members 10 opposite to developing rollers 21 in the second to fourth developing apparatuses A2 to A4, and the magenta, cyan, and black toner images formed on the image carrying members 10 are successively transferred to the intermediate transfer member 43 to which the yellow toner image has been transferred, as described above, to form a full-color toner image on the intermediate transfer member 43.

Thereafter, as in the above-mentioned first color image forming apparatus, recording sheets 46 are introduced form a paper cassette 45 provided in a lower part of the color image foming apparatus into a portion where the intermediate transfer member 43 and a transfer roller 48 are opposite to each other by feeding rollers 47, and the full-color toner image formed on the intermediate transfer member 43 is transferred to the recording sheets 46. The full-color toner image thus transferred on the recording sheets 46 is fixed to the recording sheets 46 by a fixing device 49 to discharge the recording sheets 46, while the toners remaining on the intermediate transfer member 43 without being transferred are removed from to intermediate transfer member 43 by a cleaning device 50.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

What is claimed is:

1. A developing apparatus comprising:

a developing roller for conveying toners held on its surface to a developing area opposite to an image carrying member, the surface of the developing roller being moved upward from below in said developing area;

a regulating member for regulating an amount of the toners to be conveyed to the developing area by said developing roller;

a plate-shaped charging member for charging the toners; and a voltage applying device for applying a voltage to said charging member.

2. The developing apparatus according to claim 1, wherein a portion of said charging member is in contact with said developing roller.

3. The developing apparatus according to claim 2, wherein the portion, in contact with said developing roller, of said charging member comprises a material positioned in a triboelectric series for charging the toners to a predetermined polarity.

4. The developing apparatus according to claim 2, wherein the toners are negatively charged toners, and the portion, in contact with said developing roller, of said charging member comprises a material whose work function is not more than a work function of the toners.

5. The developing apparatus according to claim 2, wherein ten-point average roughness Rz in the portion, in contact with said developing roller, of said charging member satisfies $0.1\ \mu m \leqq Rz \leqq 2.0\ \mu m$.

6. The developing apparatus according to claim 2, wherein line pressure p in the portion, in contact with said developing roller, of said charging member satisfies $0.1\ gf/mm \leqq p \leqq 4.0\ gf/mm$.

7. The developing apparatus according to claim 1, wherein said charging member is positioned on the upstream side of said regulating member with respect to the surface-moving direction of the developing roller.

8. The developing apparatus according to claim 1, wherein the developing apparatus is a developing apparatus using a mono-component developer containing toners.

9. The developing apparatus according to claim 1, wherein said regulating member charges the toners held on the developing roller.

10. An image forming apparatus comprising:

a developing apparatus; and an image carrying member, the developing apparatus comprising a developing roller for conveying toners held on its surface to a developing area opposite to said image carrying member, the surface of the developing roller being moved upward from below in said developing area, a regulating member for regulating an amount of the toners to be conveyed to the developing area by said developing roller, a plate-shaped charging member for charging the toners, and a voltage applying device for applying a voltage to said charging member, wherein a surface of the image carrying member is moved upward from below in said developing area.

11. The image forming apparatus according to claim 10, wherein said charging member is positioned on the upstream side of said regulating member with respect to the surface-moving direction of the developing roller.

12. The image forming apparatus according to claim 10, further comprising an intermediate transfer member to which a toner image formed on said image carrying member is transferred.

13. The image forming apparatus according to claim 10, wherein the image forming apparatus is a color image forming apparatus using a plurality of developing apparatuses respectively using toners which differ in color.

14. A developing apparatus comprising:

a developing roller for conveying toners held on its surface to a developing area opposite to an image carrying member, the surface of the developing roller being moved upward from below in said developing area;

a plate-shaped regulating member for regulating an amount of the toners to be conveyed to the developing area by said developing roller; and a plate-shaped charging member for charging the toners, the charging member being positioned on the upstream side of said regulating member with respect to the surface-moving direction of the developing roller, the charging member having a free end and a fixed end, the free end being positioned on a downstream side of the fixed end with respect to the surface-moving direction of the developing roller, and a distance d from a point at which the charging member starts to come into contact with the developing roller to the free end being not less than 0.3 mm.

15. The developing apparatus according to claim 14, wherein the regulating member has a free end and a fixed end, a space s between the free end of said charging member and the free end of said regulating member is not less than 0.2 mm.

16. An image forming apparatus comprising:

a developing apparatus; and an image carrying member, the developing apparatus comprising a developing roller for conveying toners held on its surface to a developing area opposite to said image carrying member, the surface of the developing roller being moved upward from below in said developing area, a plate-shaped regulating member for regulating an amount of the toners to be conveyed to the developing area by said developing roller, and a plate-shaped charging member charging the toners, the charging member being positioned on the upstream side of said regulating member having a free end surface-moving direction of the developing roller, the charging member having a free end and a fixed end, the free end, being positioned on a downstream side of the fixed end with respect to the surface-moving direction of the developing roller, and a distance d from a point at which the charging member starts to come into contact with the developing roller to the free end being not less than 0.3 mm, wherein a surface of the image carrying member is moved upward from below in said developing area.

17. The image forming apparatus according to claim 16, wherein the regulating member has a free end and fixed end, a space s between the free end of said charging member and the free end of said regulating member is not less than 0.2 mm.

18. The image forming apparatus according to claim 16, further comprising an intermediate transfer member to which a toner image formed on said carrying member is transferred.

19. The image forming apparatus according to claim 16, wherein the image forming apparatus is a color image forming apparatus using a plurality of developing apparatuses respectively using toners which differ in color.

20. A developing apparatus comprising:

a developing roller for conveying toners held on its surface to a developing area opposite to an image carrying member, the surface of the developing roller being moved upward from below in said developing area;

a toner supplying member for supplying the toners to the developing roller;

a charging member for charging the toner supplied by the toner supplying member, the charging member being disposed in contact with the developing roller and being positioned on the downstream side of the toner supplying member with respect to the surface-moving direction of the developing roller;

a voltage applying device for applying a voltage to the charging member; and a regulating member for regulating an amount of the toners to be conveyed to the developing area by the developing roller, the regulating member being positioned on the downstream side of the charging member with respect to the surface-moving direction of the developing roller.

21. The developing apparatus according to claim 20, wherein the toner supplying member is a toner supplying roller, the charging member is a plate-shaped charging member and the regulating member is a plate-shaped regulating member.

22. A developing apparatus comprising:

a developing roller for conveying toners held on its surface to a developing area opposite to an image carrying member, the surface of the developing roller being moved upward from below in said developing area;

a toner supplying member for supplying the toners to the developing roller;

a plate-shaped charging member for charging the toners supplied by the toner supplying member, the charging member being disposed in contact with the developing roller and being positioned on the downstream side of the toner supplying member with respect to the surface-moving direction of the developing roller, the charging member having a free end and a fixed end, a distance d from a point at which the charging member starts to come into contact with the developing roller to the free end being not less than 0.3 mm; and a plate-shaped regulating member for regulating an amount of the toners to be conveyed to the developing area by the developing roller, the regulating member being positioned on the downstream side of the charging member with respect to the surface-moving direction of the developing roller.

23. The developing apparatus according to claim 22, wherein the toner supplying member is a toner supplying roller.

* * * * *